US007207363B1

(12) United States Patent
Liu et al.

(10) Patent No.: US 7,207,363 B1
(45) Date of Patent: Apr. 24, 2007

(54) CUTTING MACHINE

(75) Inventors: Ta-Chang Liu, Taichung (TW); Ming-Hui Huang, Taichung Hsien (TW)

(73) Assignee: P & F Brother Industrial Corporation, Taichung (TW)

( * ) Notice: Subject to any disclaimer, the term of this patent is extended or adjusted under 35 U.S.C. 154(b) by 0 days.

(21) Appl. No.: 11/429,302

(22) Filed: May 5, 2006

(51) Int. Cl.
*B27B 31/00* (2006.01)
*B27C 1/12* (2006.01)
*B27C 5/02* (2006.01)

(52) U.S. Cl. ..... 144/253.6; 144/253.1; 144/286.5; 144/1.1

(58) Field of Classification Search ..... 144/253.1, 144/253.5, 253.6, 253.8, 286.5, 287, 286.1, 144/1.1; 83/412–415, 440, 477.2, 467.1, 83/468.7, 468.5, 468.6
See application file for complete search history.

(56) References Cited

U.S. PATENT DOCUMENTS 6,095,024 A * 8/2000 Brutscher et al. ..... 83/35
6,148,703 A * 11/2000 Ceroll et al. ..... 83/13
6,679,305 B2 * 1/2004 Petersen ..... 144/253.1
7,036,414 B2 * 5/2006 Behne et al. ..... 83/468.7

* cited by examiner

*Primary Examiner*—Bena Miller
(74) *Attorney, Agent, or Firm*—Frommer Lawrence & Haug LLP; Ronald R. Santucci

(57) ABSTRACT

A cutting machine includes: a base; a worktable provided on the base and having a working surface and a lateral side; a cutter provided on the worktable; and an elongate fence having first and second long edges and pivoted to the lateral side of the worktable so as to be rotatable relative to the worktable about an axis. The axis is spaced apart from the first and second long edges of the fence by first and second distances, respectively, and is spaced apart from the working surface of the worktable by a third distance. The first distance is greater than the third distance, while the second distance is not greater than the third distance.

2 Claims, 8 Drawing Sheets

CUTTING MACHINE

BACKGROUND OF THE INVENTION

1. Field of the Invention

The invention relates to a cutting machine, more particularly to a cutting machine with a fence that is easily adjusted during a cutting operation.

2. Description of the Related Art

Referring to FIGS. 1 and 2, a conventional cutting machine is shown to include a base 1 adapted to stand on a ground, a worktable 2 provided on the base 1, and a cutter 3 provided on the worktable 2. The worktable 2 is used to support a workpiece 4 moving toward the cutter 3 during a cutting operation. An extension part 10 is provided on the worktable 2, and is extendible from a lateral side of the worktable 2. When the workpiece 4 is too long such that an end portion thereof extends beyond the lateral side of the worktable 2, the extension part 10 can be extended laterally from the lateral side of the worktable 2 to support the end portion of the workpiece 4. The extension part 10 includes a supporting member 12, and a fence member 13 that has a fence portion 131 mounted movably on the supporting member 12, and a supporting portion 132 extending transversely from the fence portion 131. The fence portion 131 is formed with a pair of stepped guiding grooves 1311. A pair of screw rods 14 extend respectively through the guiding grooves 1311, and engage threadedly the supporting member 12, thereby permitting sliding movement of the fence member 13 along a stepped path defined by the guiding grooves 1311. As such, when the fence member 13 is to be used for abutting against one end face of the workpiece 4 during cutting, the fence member 13 is lifted along the stepped path (see FIG. 2), and is then fastened to the supporting member 12 by tightening the screw rods 14. On the other hand, when the fence member 13 is not required for abutting against the end face of the workpiece 4, the fence member 13 is lowered down along the stepped path (not shown) such that an upper surface of the fence member 13 is flush with an upper surface of the worktable 12 and that the upper surface of the fence member 13 can be used to support the workpiece 4.

The conventional cutting machine is disadvantageous in that adjustment of the fence member 13 is relatively inconvenient during a cutting operation.

SUMMARY OF THE INVENTION

Therefore, the object of the present invention is to provide a cutting machine that can overcome the aforesaid drawback associated with the prior art.

Accordingly, a cutting machine of this invention comprises: a base; a worktable provided on the base and having a working surface and a lateral side; a cutter provided on the worktable; and an elongate fence having first and second long edges that are opposite to each other in a transverse direction relative to the length of the fence, and pivoted to the lateral side of the worktable so as to be rotatable relative to the worktable about an axis. The axis is disposed between and is spaced apart from the first and second long edges of the fence in the transverse direction by first and second distances, respectively, and is spaced apart from the working surface of the worktable by a third distance. The first distance is greater than the third distance, while the second distance is not greater than the third distance.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
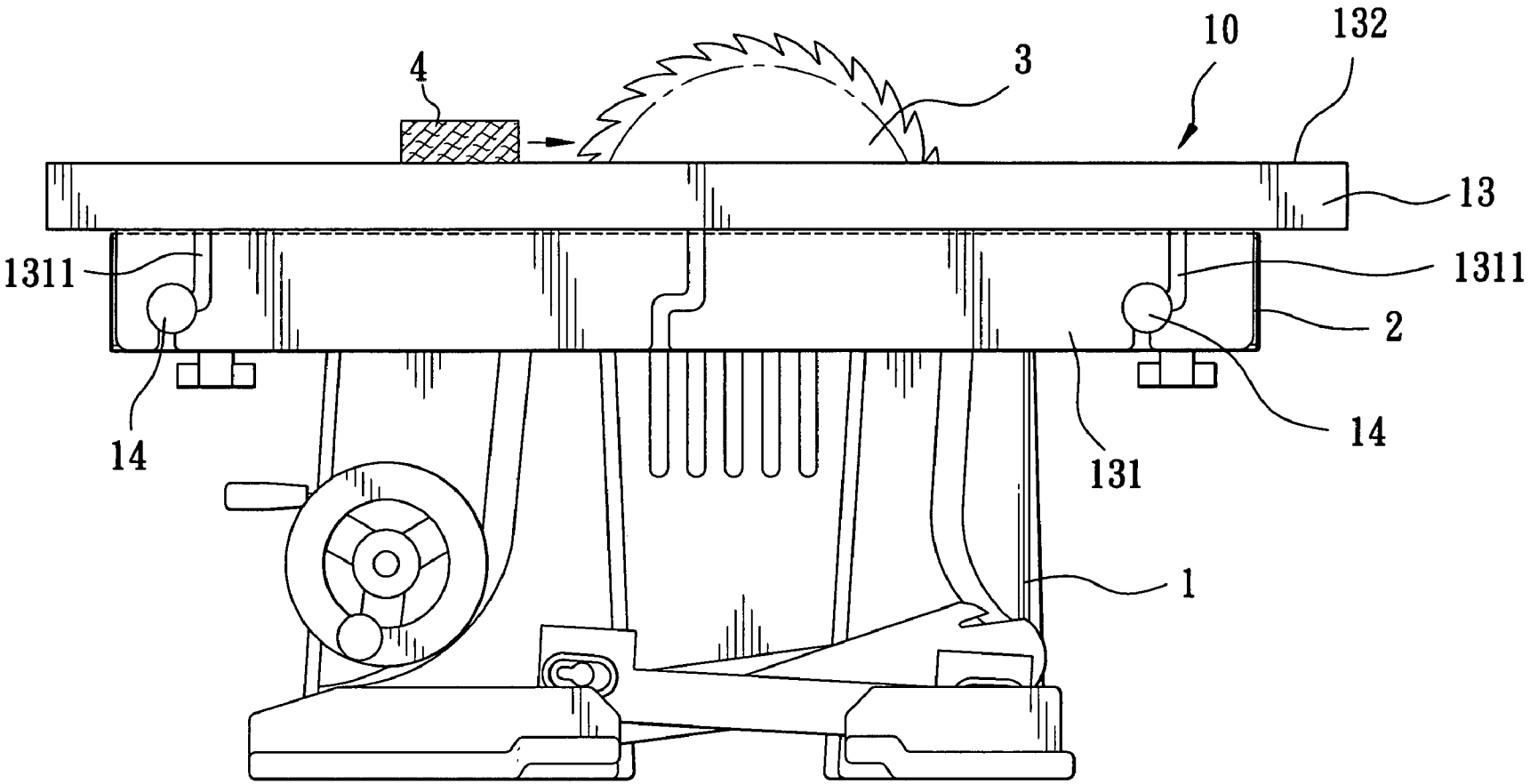
FIG. 1 PRIOR ART
FIG. 1 is an assembled side view of a conventional cutting machine.
Figure 2:
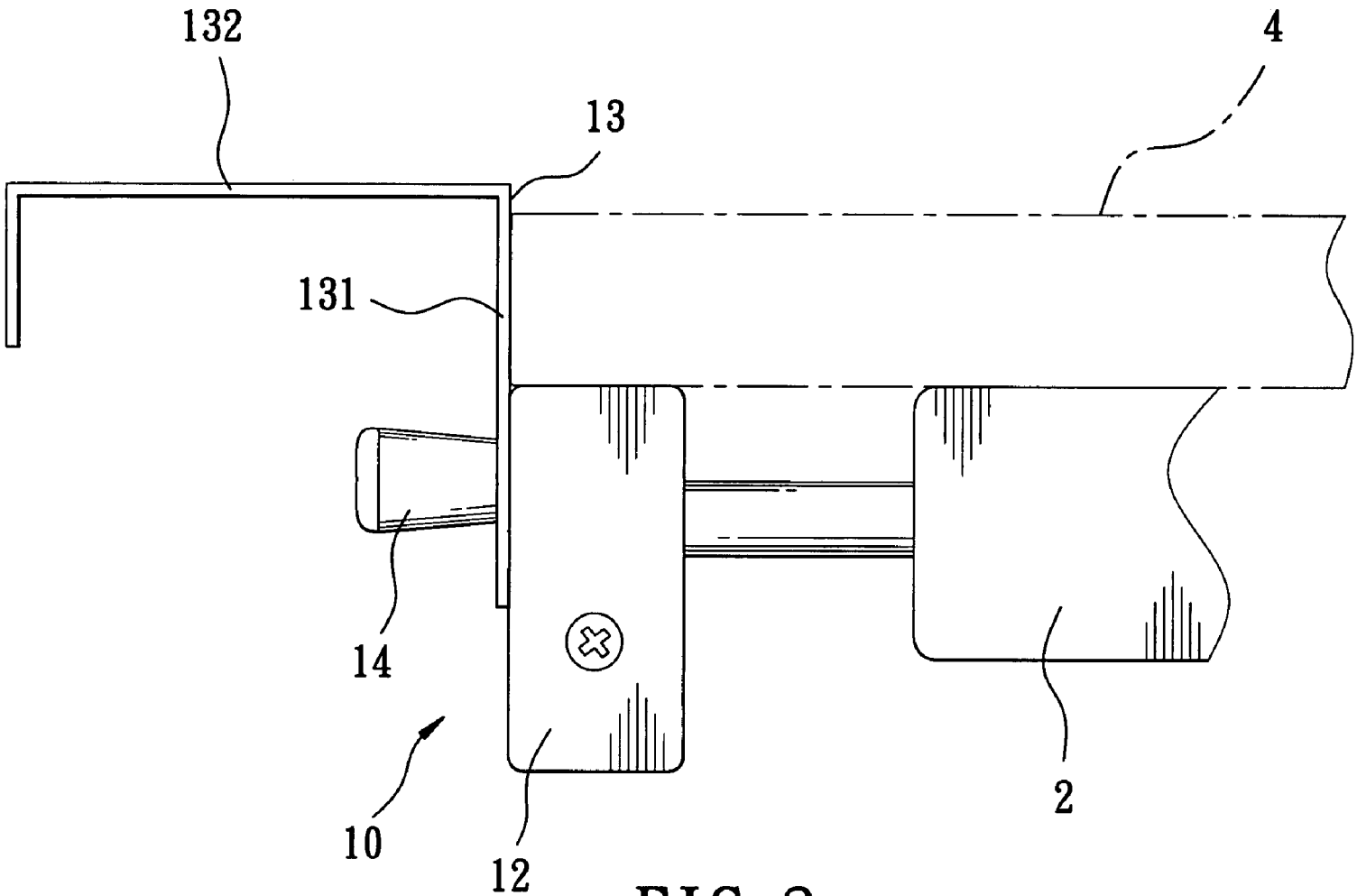
FIG. 2 PRIOR ART
FIG. 2 is a fragmentary side view of the conventional cutting machine.
Figure 3:
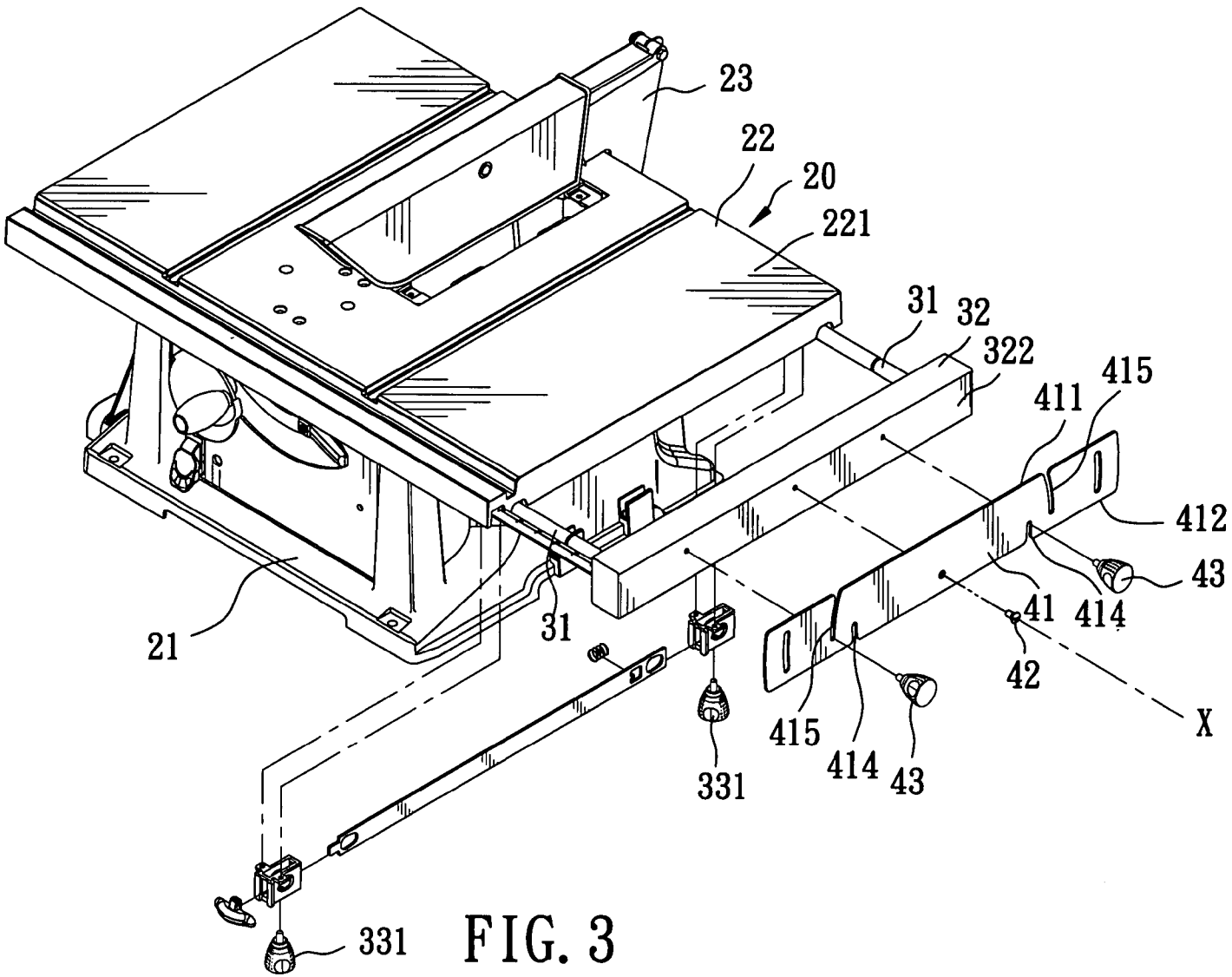
FIG. 3 is a partly exploded perspective view of the preferred embodiment of a cutting machine according to the present invention.
Figure 4:
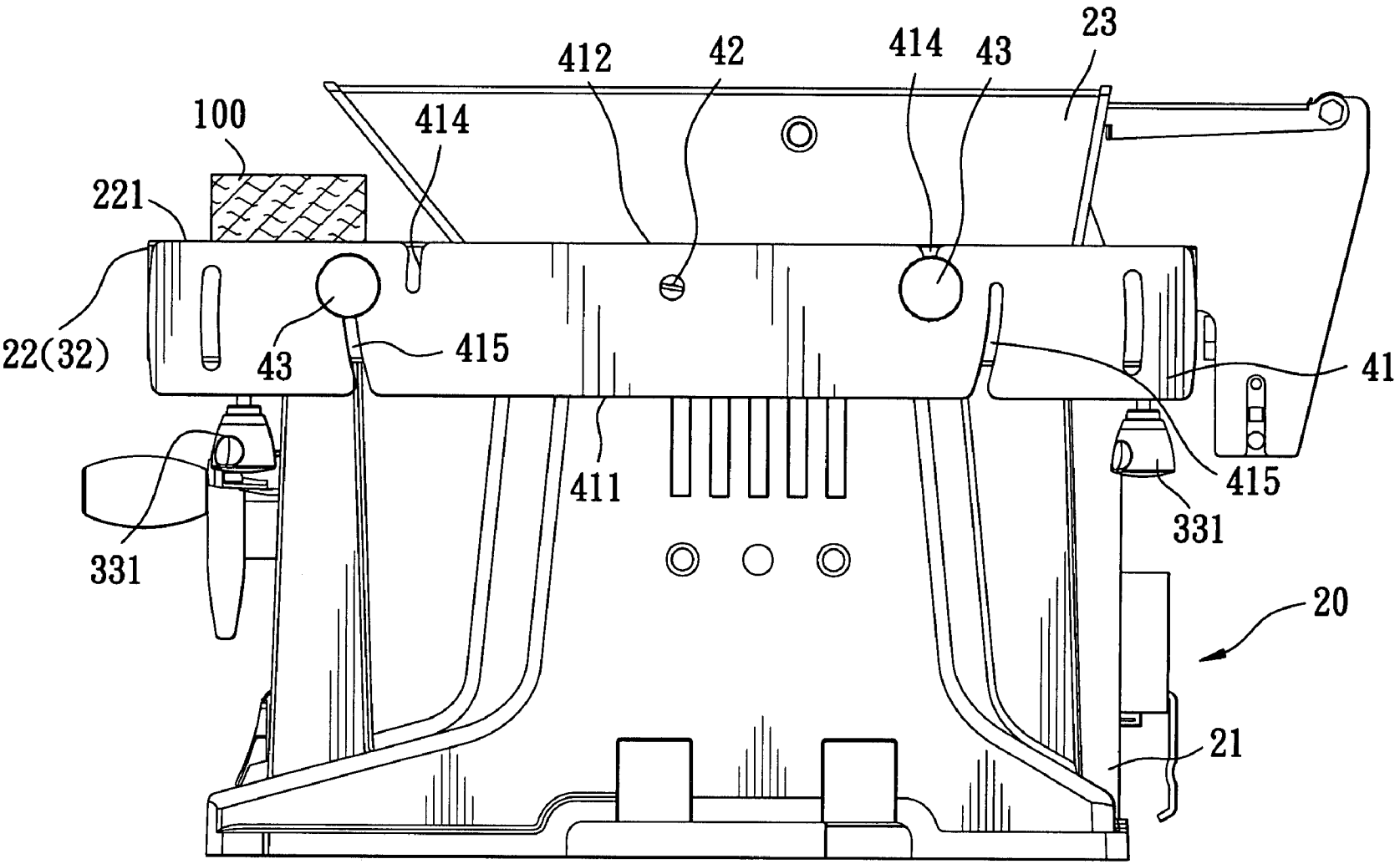
FIG. 4 is an assembled side view of the preferred embodiment to illustrate a state where a fence is disposed at a second position in which the top end of the fence is flush with the top end of an extension part of a worktable of the preferred embodiment.
Figure 5:
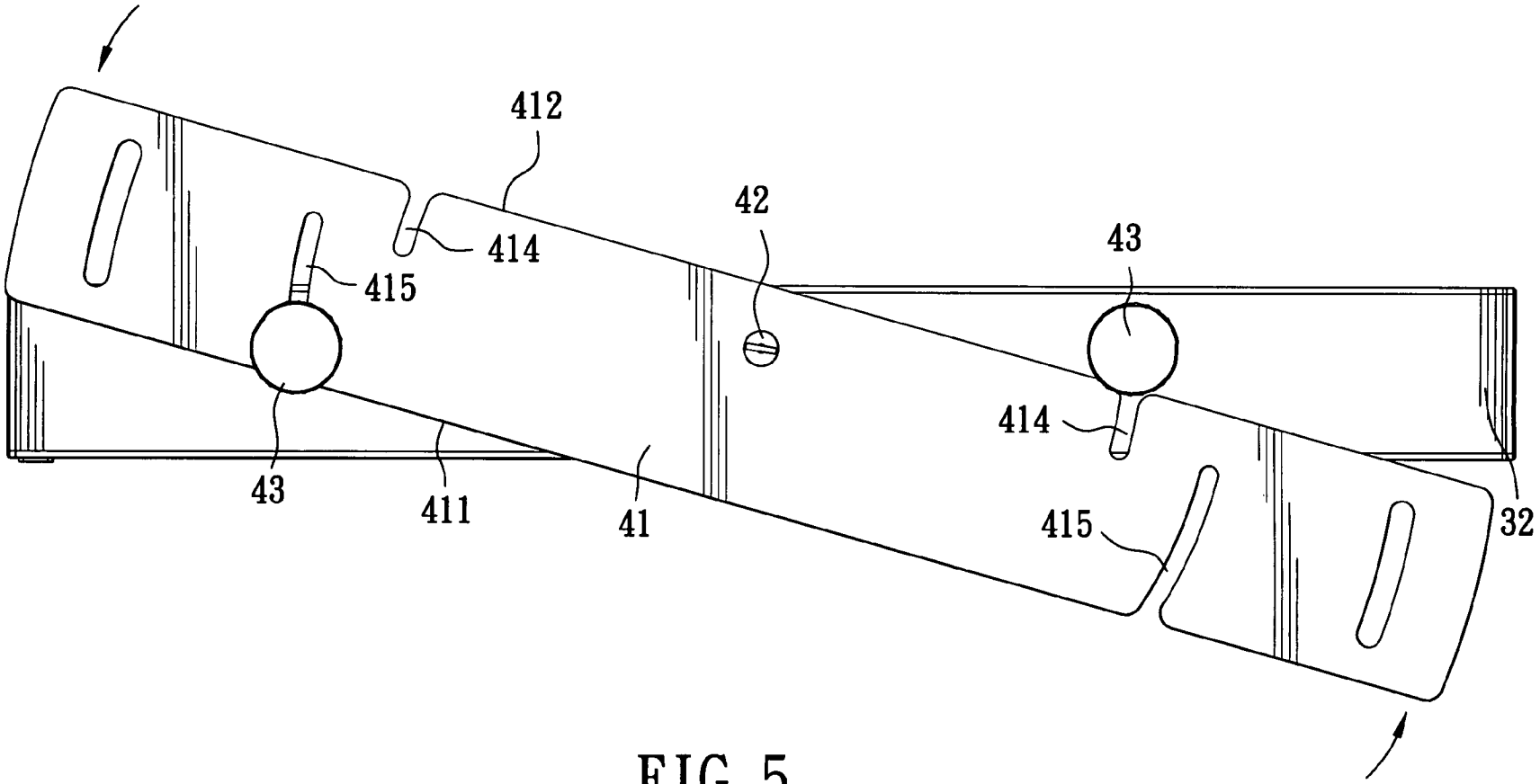
FIG. 5 is a schematic side view for illustrating how the fence of the preferred embodiment is rotated relative to the worktable about an axis to the second position.
Figure 6:
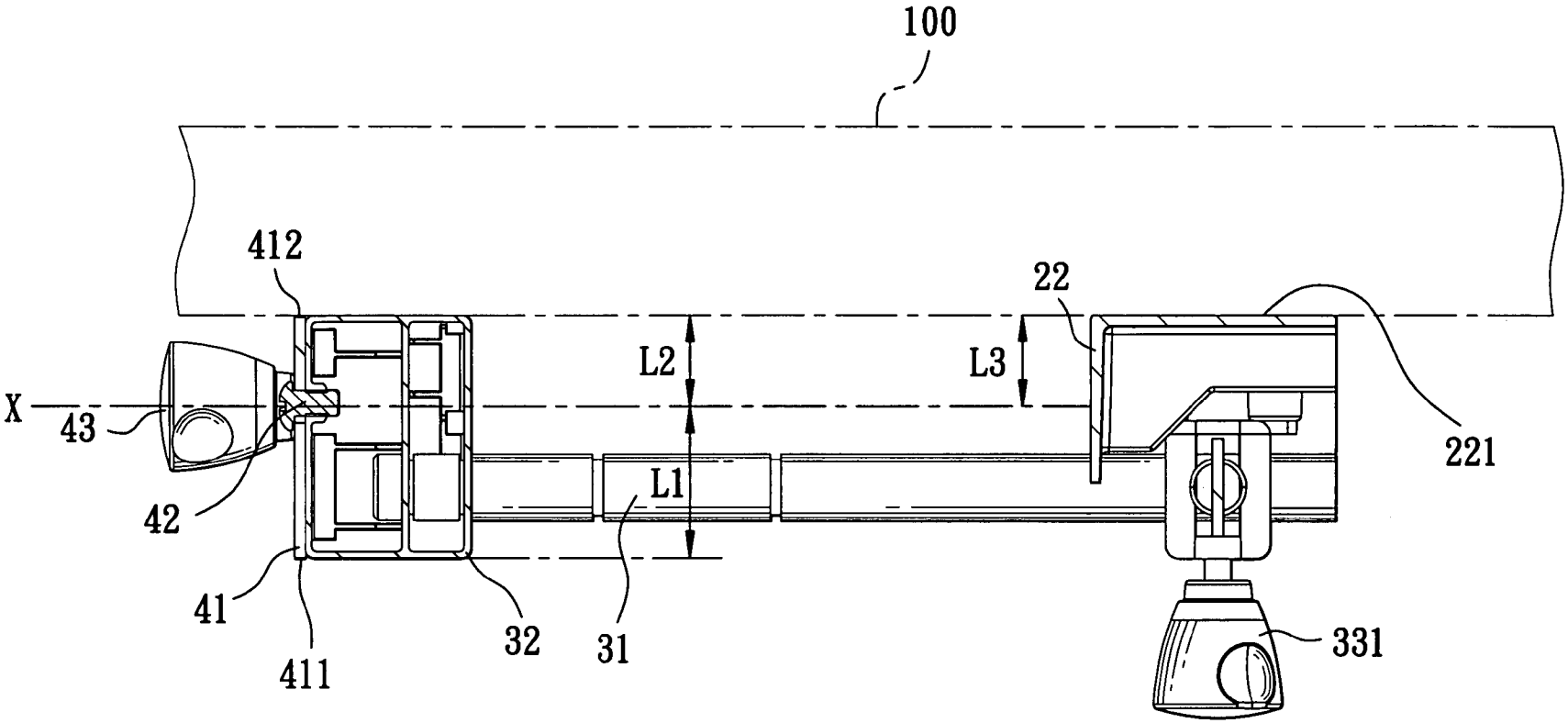
FIG. 6 is a partly sectional view for illustrating the state where the fence is disposed at the second position.

Referring to FIGS. 3, 4 and 5, the preferred embodiment of a cutting machine according to the present invention is shown to include: a base 21; a worktable 20 provided on the base 21 and having a working surface 221 for supporting a workpiece 100, and a lateral side 322; a cutter 23 provided on the worktable 20; and an elongate fence 41 having first and second long edges 411, 412 that are opposite to each other in a transverse direction relative to the length of the fence 41, and pivoted to the lateral side 322 of the worktable 20 through a pivot pin 42 so as to be rotatable relative to the worktable 20 about an axis (X) between a first position (see FIGS. 7 and 8) and a second position (see FIGS. 4 and 6). The axis (X) is disposed between and is spaced apart from the first and second long edges 411, 412 of the fence 41 in the transverse direction by first and second distances (L1, L2) (see FIGS. 6 and 8), respectively, and is spaced apart from the working surface 221 of the work table 20 by a third distance (L3). The first distance (L1) is greater than the third distance (L3) so that the fence 41 extends beyond the working surface 221 of the worktable 20 when the fence 41 is disposed at the first position (see FIG. 8), thereby permitting abutment of an end face of the workpiece 100 against the fence 41 during a cutting operation. The second distance (L2) is not greater than the third distance (L3) so that the fence 41 does not extend beyond the working surface 221 of the worktable 20 when the fence 41 is disposed at the second position (see FIG. 6), thereby permitting lateral extension of the workpiece 100 beyond the second long edge 412 of the fence 41. In this embodiment, the second distance (L2) is substantially equal to the third distance (L3) so that the second long edge 412 of the fence 41 is substantially flush with the working surface 221 of the worktable 20 when the fence 41 is disposed at the second position.

Figure 7:
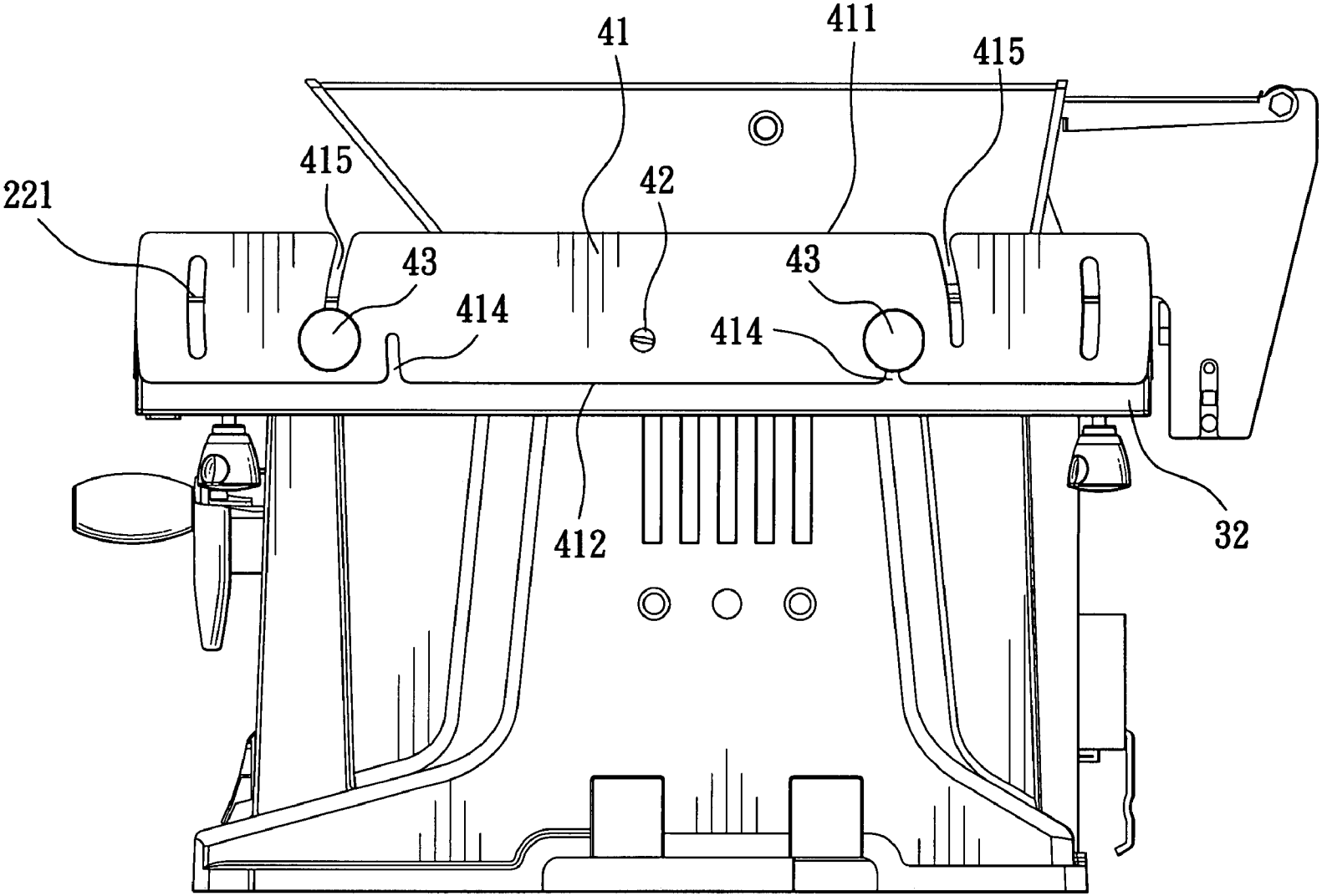
FIG. 7 is a schematic side view for illustrating another state where the fence is disposed at a first position in which the top end of the fence extends beyond the top end of the worktable.
Figure 8:
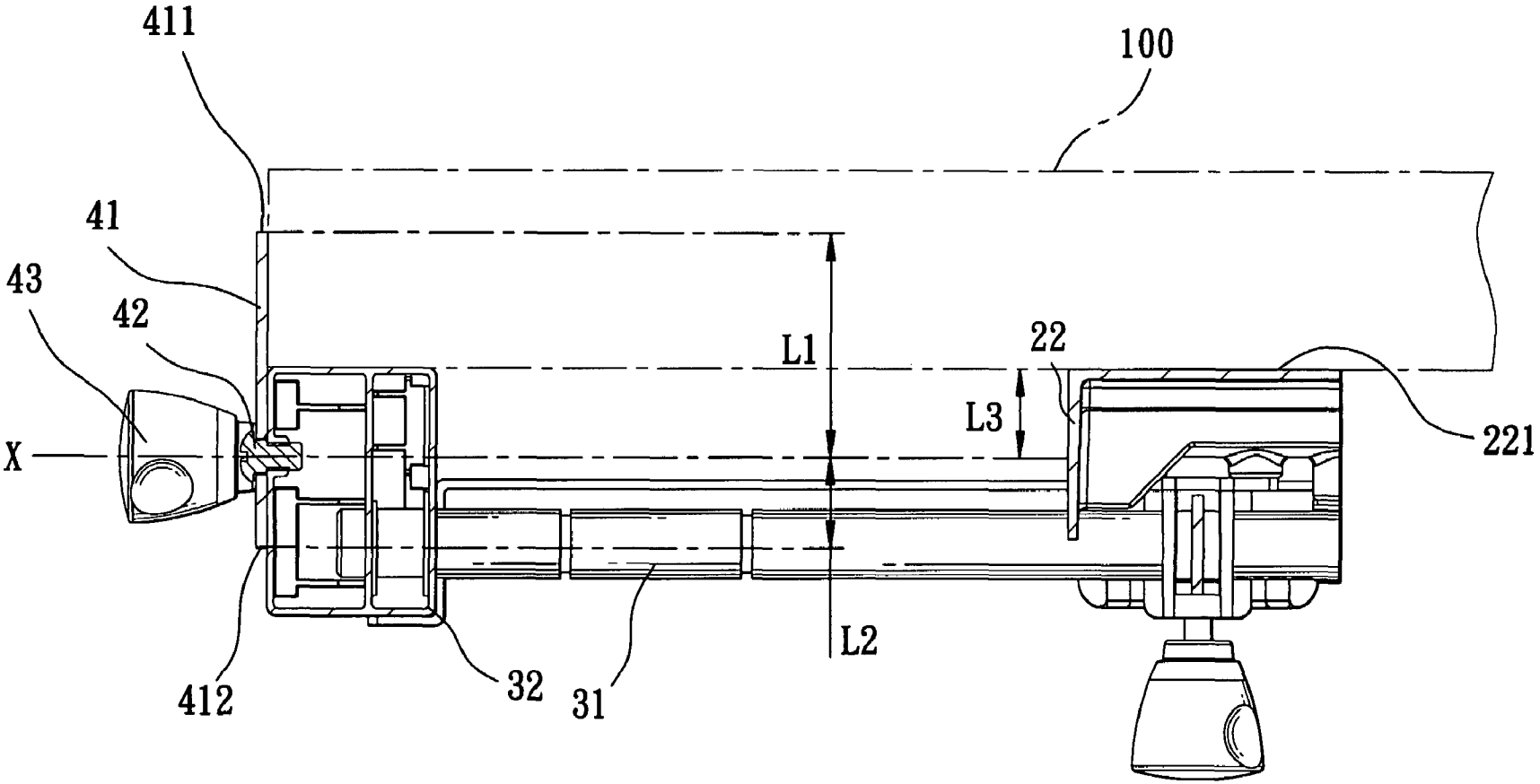
FIG. 8 is a partly sectional view for illustrating the state where the fence is disposed at the first position.

In this embodiment, the fence 41 is formed with a pair of opposing long grooves 415 indented inwardly from the first long edge 411 of the fence 41 and extending along a first curve centered about the axis (X), and a pair of opposing short grooves 414 indented inwardly from the second long edge 412 of the fence 41, extending along a second curve centered about the axis (X) and disposed between the long grooves 415. A holding unit includes a pair of screw members 43 extending through the fence 41 and engaging threadedly the lateral side 322 of the worktable 20 so as to hold the fence 41 to the worktable 22. One of the screw members 43 extends through a selected one of the long grooves 415. The other of the screw members 43 extends through one of the short grooves 414 that is distal from the selected one of the long grooves 415 when the fence 41 is rotated to a corresponding one of the first and second positions, as best shown in FIGS. 4 and 7

The worktable 20 includes a main table part 22, and an extension part 32 that defines the lateral side 322 of the worktable 20 and that is connected to a pair of slidable rods 31 which are mounted slidably on a bottom of the main table part 22, thereby permitting lateral extension and retraction of the extension part 32 relative to the main table part 22. The slidable rods 31 are fastened to the main table part 22 through a pair of fastening members 331, and are slidable relative to the main table part 22 when the fastening members 331 are loosened.

By forming the long grooves 415 and the short grooves 414 and by having the fence 41 pivoted to the lateral side 322 of the worktable 20 of the cutting machine of this invention, the aforesaid drawback of inconvenience associated with the prior art can be alleviated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A cutting machine comprising:

a base;

a worktable provided on said base and having a working surface and a lateral side;

a cutter provided on said worktable; and an elongate fence having first and second long edges that are opposite to each other in a transverse direction relative to the length of said fence, said fence being pivoted to said lateral side of said worktable so as to be rotatable relative to said worktable about an axis, said axis being disposed between and being spaced apart from said first and second long edges of said fence in said transverse direction by first and second distances, respectively, and being spaced apart from said working surface of said worktable by a third distance;

wherein said first distance is greater than said third distance, while said second distance is not greater than said third distance;

wherein said fence is rotatable about said axis between first and second positions, and is formed with a pair of opposing long grooves indented inwardly from said first long edge of said fence and extending along a first curve centered about said axis, and a pair of opposing short grooves indented inwardly from said second long edge of said fence, extending along a second curve centered about said axis, and disposed between said long grooves, said cutting machine further comprising a holding unit that includes a pair of screw members extending through said fence and engaging threadedly said lateral side of said worktable so as to hold said fence to said worktable, one of said screw members extending through a selected one of said long grooves, the other of said screw members extending through one of said short grooves that is distal from the selected one of said long grooves when said fence is rotated to a corresponding one of said first and second positions.

2. The cutting machine as claimed in claim 1, wherein said worktable includes a main table part, and an extension part that is extendable laterally from said main table part, said extension part defining said lateral side of said worktable.

* * * * *